United States Patent [19]

Sugimoto et al.

[11] Patent Number: 4,645,735

[45] **Date of Patent: * Feb. 24, 1987**

[54] SILVER HALIDE PHOTOGRAPHIC LIGHT-SENSITIVE MATERIAL CONTAINING ULTRAVIOLET RAY ABSORBING POLYMER LATEX

[75] Inventors: Naohiko Sugimoto; Tetsuro Kojima; Shingo Ishimaru, all of Kanagawa, Japan

[73] Assignee: Fuji Photo Film Co., Ltd., Japan

[ * ] Notice: The portion of the term of this patent subsequent to Feb. 14, 2001 has been disclaimed.

[21] Appl. No.: 712,314

[22] Filed: Mar. 13, 1985

Related U.S. Application Data

[63] Continuation of Ser. No. 520,771, Aug. 5, 1983, abandoned.

[30] Foreign Application Priority Data

Aug. 5, 1982 [JP] Japan ..... 57-136612

[51] Int. Cl.[4] ..... G03C 1/84

[52] U.S. Cl. ..... 430/512; 430/503; 430/505; 430/523; 430/527; 430/543; 430/931

[58] Field of Search ..... 430/512, 527, 931, 507, 430/503, 505, 523, 528, 536, 537, 543

[56] References Cited

U.S. PATENT DOCUMENTS 4,431,726 2/1984 Kojima et al. ..... 430/512
4,443,534 4/1984 Kojima et al. ..... 430/512
4,464,462 8/1984 Sugimoto et al. ..... 430/512

*Primary Examiner*—Jack P. Brammer
*Attorney, Agent, or Firm*—Sughrue, Mion, Zinn, Macpeak & Seas

[57] ABSTRACT

A silver halide photographic light-sensitive material is disclosed. The material is comprised of a support base having positioned thereon a light-sensitive silver halide emulsion layer, a light-insensitive layer and ultraviolet ray absorbing polymer latex of a polymer having a repeating unit derived from a monomer represented by the general formula (I):

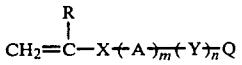

within general formula (I) the substituents are defined within the specification. The Q represents an ultraviolet ray absorbing group represented by a general formula (II) or (III):

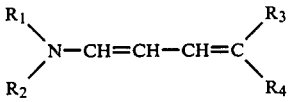

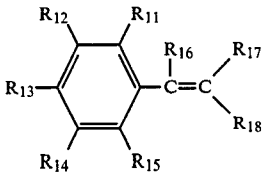

The substituents within the general formulae given above are defined in the specification. By including the particular ultraviolet ray absorbing polymer latex of the invention the resulting photographic material has improved antistatic properties and the photographic characteristics of the material are not deteriorated by the presence of the latex.

15 Claims, No Drawings

SILVER HALIDE PHOTOGRAPHIC LIGHT-SENSITIVE MATERIAL CONTAINING ULTRAVIOLET RAY ABSORBING POLYMER LATEX

This is a continuation of application Ser. No. 520,771, filed Aug. 5, 1983, now abandoned.

FIELD OF THE INVENTION

The present invention relates to silver halide photographic light-sensitive materials (hereinafter, referred to as "photographic light-sensitive materials") and, particularly, to photographic light-sensitive materials having an improved coating aptitude and an improved antistatic property.

BACKGROUND OF THE INVENTION

Since photographic light-sensitive materials are generally composed of a base and photographic layers, electrostatic charges are frequently accumulated due to contact friction between surfaces of the same kind or different kind of materials or separation thereof when producing the photographic light-sensitive materials or when using them. The accumulated electrostatic charges cause many problems. The most serious problem being that the light-sensitive emulsion layers are exposed by the discharge of electrostatic charges accumulated before development, by which dot spots or branched or feathery linear marks are caused when the photographic films are subjected to development processing. This creates so-called static mark, which causes the commercial value of photographic films to be remarkably damaged or completely lost. For example, when it appears on medical or industrial X-ray films, it can be easily understood to result in a very dangerous judgement. This phenomenon is one of the most troublesome problem, because it becomes clear only after development. Further, these accumulated electrostatic charges cause secondary problems. For example, dusts adhere to the surface of films or uniform coating can not be carried out.

Such electrostatic charges are frequently accumulated, as described above, when producing or using the photographic light-sensitive materials. For example, during production, they are generated by contact friction between the photographic film and a roll or separation of the emulsion face from the base face during winding or rewinding the photographic film. Further, they are generated by contact and separation of mechanical parts or fluorescent sensitizing paper in an automatic camera for X-ray films. In color negative films and color reversal films, they are generated by contact and separation of rolls and bars made of rubber, metal or plastics, etc. in the camera or the binding apparatus or automatic developing apparatus in a development work. Furthermore, they are generated by contact with packing materials. Generation of static marks on the photographic light-sensitive materials induced by accumulation of such electrostatic charges becomes remarkable with the increase in sensitivity of photographic light-sensitive materials and increase of the processing rate thereof. Particularly, in the recent years, the static mark is more easily generated, because the photographic light-sensitive materials are highly sensitized and there are many opportunities for subjecting the material to severe handling such as high speed coating, high speed photographing or high speed automatic processing, etc.

To remove the problems caused by static electricity the use of an ultraviolet ray absorbing agents in photographic light-sensitive materials has been suggested. This idea originated from the fact that spectral energy distribution of discharge luminescence for generating the static mark is in a range of 200 nm to 500 nm and the intensity thereof is particularly high in a range of 300 to 400 nm, and light energy in this range causes the static mark. Hitherto, it has been attempted to prevent generation of static mark by intercepting ultraviolet rays of, particularly, 300 to 400 nm by means of ultraviolet ray absorbing agents described in, for example, Japanese Patent Publication No. 10726/75, Japanese Patent Application (OPI) No. 26021/76 and French Patent No. 2,036,679, etc. The ultraviolet ray absorbing agents can be used for not only a protective layer and a blue-sensitive layer but also an antihalation layer (AH) or a gelatin black layer (BC) for preventing generation of static mark on the red sensitive layer caused by discharge luminescence on the back side. However, the coating aptitude can be substantially deteriorated when application is carried out by adding the ultraviolet ray absorbing agent as an emulsion in oil to AH or BC. This deterioration is caused by a repelling phenomenon due to the so-called oil drop, the oil (high boiling point organic solvent) used for emulsification. This phenomenon is more easily generated as the amount of the emulsion and the time for resolving the emulsion are increased. Because of this phenomenon, it is necessary to restrict the amount of emulsion used for the AH layer or the BC layer, and, consequently, it is difficult to give a sufficient antistatic property to the photographic light-sensitive materials.

SUMMARY OF THE INVENTION

Accordingly, a primary object of the present invention is to provide photographic light-sensitive materials having an improved coating aptitude.

Another object of the present invention is to provide photographic light-sensitive materials in which generation of static mark by discharge, particularly, on the back face is nearly completely prevented.

As a result of earnest studies, the present inventors have found that these objects of the present invention can be attained by using an ultraviolet ray absorbing polymer latex of a polymer or copolymer having a repeating unit derived from a monomer represented by the following formula (I) in a hydrophilic colloid layer present between the emulsion layer and the base or on the opposite side of the base to the emulsion layer.

General formula (I)

$$CH_2{=}\overset{\overset{\displaystyle R}{|}}{C}{-}X{-}(A)_m{-}(Y)_n{-}Q$$

In the formula, R represents a hydrogem atom, a lower alkyl group having 1 to 4 carbon atoms (for example, a methyl group, an ethyl group, a n-propyl group, an isopropyl grou or a n-butyl group, etc.) or a chlorine atom; X represents —COHN—, —COO— or a phenylene group; A represents a bonding group selected from an alkylene group having 1 to 20 carbon atoms (for example, a methylene group, an ethylene group, a trimethylene group, a 2-hydroxytrimethylene group, a pentamethylene group, a hexamethylene group, an ethylethylene group, a propylene group or a decamethylene group, etc.) and an arylene group having 6 to 20 carbon atoms (for example, a phenylene group, etc.), and Y represents —COO—, —OCO—, —CONH—, —NHCO—, —$SO_2$NH—, —NH$SO_2$—, —$SO_2$— or —O—. Further, m and n each represents 0 or 1.

Q represents an ultraviolet ray absorbing group represented by the following general formula (II) or (III).

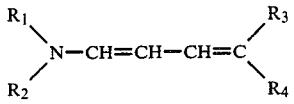

General formula (II)

In the formula, $R_1$ and $R_2$ each represents a hydrogen atom, an alkyl group having 1 to 20 carbon atoms (for example, a methyl group, an ethyl group, a n-butyl group, a cyclohexyl group, a n-dodecyl group, an octadecyl group, a methoxyethyl group, an ethoxypropyl group, a hydroxyethyl group, a chloropropyl group, a cyanoethyl group, a phenetyl group, a benzyl group, an ethoxycarbonylmethyl group or a 2-(2-hydroxyethoxy)ethyl group, etc.) or an aryl group having 6 to 20 carbon atoms (for example, a tolyl group, a phenyl group, a chlorophenyl group or a 2,4-di-t-amylphenyl group, etc.), and $R_1$ and $R_2$ may be identical or different each other but they do not represent hydrogen atoms at the same time. Further, $R_1$ and $R_2$ may be united, and, in such a case, they represent an atomic group necessary to form a cyclic amino group (for example, a piperidino group, a morpholine group, a pyrrolidino group, a hexahydroazepino group or a piperazino group, etc.). $R_3$ represents a cyano group, —$COOR_5$, —$CONHR_5$, —$COR_5$ or —$SO_2R_5$, and $R_4$ represents a cyano group, —$COOR_6$, —$CONHR_6$, —$COR_6$ or —$SO_2R_6$, wherein $R_5$ and $R_6$ each represents an alkyl group having 1 to 20 carbon atoms or an aryl group having 6 to 20 carbon atoms, which has the same meaning as the alkyl group or aryl group represented by $R_1$ or $R_2$. Further, $R_5$ and $R_6$ may be united and, in such a case, they represents an atomic group necessary to form a 1,3-dioxocyclohexane ring (for example, dimedone, etc.), a 1,3-diaza-2,4,6-trioxocyclohexane ring (for example, barbituric acid or 1-phenylbarbituric acid, etc.), a 1,2-diaza-3,5-dioxocyclopentane ring (for example, 1,2-diaza-1,2-dimethyl-3,5-dioxocyclopentane, etc.) or a 2,4-diaza-1-alkoxy-3,5-dioxocyclohexene ring (for example, 2,4-diaza-1-ethoxy-4-ethyl-3,5-dioxocyclohexane, etc.).

Further, at least one of $R_1$, $R_2$, $R_3$ and $R_4$ must be bonded to the vinyl group through the above described bonding group.

In the general formula (II), it is preferred that $R_1$ and $R_2$ each represents an alkyl group having 1 to 20 carbon atoms, $R_3$ represents a cyano group or —$SO_2R_5$ and $R_4$ represents a cyano group or —$COOR_6$, wherein $R_5$ and $R_6$ each represents an alkyl group having 1 to 20 carbon atoms or an aryl group having 6 to 20 carbon atoms.

In the general formula (II), it is particularly preferred that $R_1$ and $R_2$ each represents an alkyl group having 1 to 6 carbons atoms, $R_3$ represents —$SO_2R_5$, and $R_4$ represents —$COOR_6$, wherein $R_5$ represents a phenyl group which may be substituted (for example, a pheyl group or a tolyl group, etc.) and $R_6$ represents an alkyl group having 1 to 20 carbon atoms.

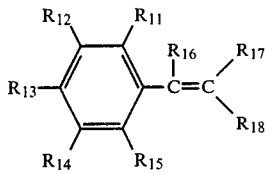

General formula (III)

In the formula, $R_{11}$, $R_{12}$, $R_{13}$, $R_{14}$ and $R_{15}$ each represents a hydrogen atom, a halogen atom (for example, a chlorine atom or a bromine atom, etc.), an alkyl group having 1 to 20 carbon atoms (for example, a methyl group, an ethyl group, a n-propyl group, a n-butyl group, a t-butyl group, a t-amyl group, a n-octyl group, a methoxyethyl group, an ethoxypropyl group, a chloropropyl group, a benzyl group, etc.), an aryl group having 6 to 20 carbon atoms (for example, a phenyl group, a tolyl group or a chlorophenyl group, etc.), an alkoxy group having 1 to 20 carbon atoms (for example, a methoxy group, an ethoxy group, a propoxy group or a methoxyethoxy group, etc.), an aryloxy group having 6 to 20 carbon atoms (for example, a phenoxy group, etc.), an alkylthio group having 1 to 20 carbon atoms (for example, a methylthio group or a propylthio group, etc.), an arylthio group having 6 to 20 carbon atoms (for example, a phenylthio group), an amino group, an alkylamino group having 1 to 20 carbon atoms (for example, a methylamino group or a dimethylamino group, etc.), an arylamino group having 6 to 20 carbon atoms (for example, an anilino group or a diphenylamino group, etc.), a hydroxy group, a cyano group, a nitro group, an acylamino group having 1 to 20 carbon atoms (for example, an acetylamino group, etc.), a carbamoyl group having 1 to 20 carbon atoms (for example, a methylcarbamoyl group, etc.), a sulfonyl group having 1 to 20 carbon atoms (for example, a methylsulfonyl group or a phenylsulfonyl group, etc.) a sulfamoyl group having 1 to 20 carbon atoms (for example, an ethylsulfamoyl group, etc.), a sulfonamido group having 1 to 20 carbon atoms (for example, a methanesulfonamido group, etc.), an acyloxy group having 1 to 20 carbon atoms (for example, an acetoxy group, etc.) or an oxycarbonyl group having 1 to 20 carbon atoms (for example, a methoxycarbonyl group, etc.), and $R_{11}$ and $R_{12}$, $R_{12}$ and $R_{13}$, $R_{13}$ and $R_{14}$ or $R_{14}$ and $R_{15}$ may form a 5- or 6-member ring by ring closure (for example, a methylenedioxy group, etc.). $R_{16}$ represents a hydrogen atom or an alkyl group having 1 to 20 carbon atoms (for example, a methyl group, an ethyl group, a n-propyl group, a n-butyl group or a n-octyl group, etc.). $R_{17}$ represents a cyano group, —$COOR_{19}$, —$CONHR_{19}$, —$COR_{19}$ or —$SO_2R_{19}$, and $R_{18}$ represents a cyano group, —$COOR_{20}$, —$CONHR_{20}$, —$COR_{20}$ or —$SO_2R_{20}$, wherein $R_{19}$ and $R_{20}$ each represents an alkyl group or an aryl group as described above.

Further, at least one of $R_{11}$, $R_{12}$, $R_{13}$, $R_{14}$, $R_{15}$, $R_{16}$, $R_{17}$ and $R_{18}$ must be bonded to the vinyl group through the above described bonding group.

In the general formula (III), $R_{11}$, $R_{12}$, $R_{13}$, $R_{14}$ and $R_{15}$ each represents a hydrogen atom, a halogen atom, an alkyl group having 1 to 20 carbon atoms, an aryl group having 6 to 20 carbon atoms, an alkoxy group having 1 to 20 carbon atoms, an aryloxy group having 6 to 20 carbon atoms, an alkylamino group having 1 to 20 carbon atoms, an arylamino group having 6 to 20 carbon atoms, a hydroxy group, an acylamino group having 1 to 20 carbon atoms, a carbamoyl group having 1 to 20 carbon atoms, an acyloxy group having 1 to 20 carbon atoms or an oxycarbonyl group having 1 to 20 carbon atoms, and $R_{11}$ and $R_{12}$, and $R_{12}$ and $R_{13}$, $R_{13}$ and $R_{14}$ or $R_{14}$ and $R_{15}$ may form a ring. $R_{16}$ represents a hydrogen atom or an alkyl group having 1 to 20 carbon atoms, $R_{17}$ represents a cyano group, —$COOR_{19}$, —$CONHR_{19}$, —$COR_{19}$ or —$SO_2R_{19}$, and $R_{18}$ represents a cyano group, —$COOR_{20}$, —$CONHR_{20}$, —$COR_{20}$ or —$SO_2R_{20}$, wherein $R_{19}$ and $R_{20}$ each represents an alkyl group having 1 to 20 carbon atoms or an aryl group having 6 to 20 carbon atoms. Further, at least one of $R_{11}$, $R_{12}$, $R_{13}$, $R_{14}$, $R_{15}$, $R_{16}$, $R_{17}$ and $R_{18}$ is must be bonded to the vinyl group through the above described bonding group.

DETAILED DESCRIPTION OF THE INVENTION

In compounds represented by the above described general formula (I), it is particularly preferred that R represents a hydrogen atom or a lower alkyl group having 1 to 4 carbon atoms or a chlorine atom, X represents —COO—, and m and n each represents O, and Q represents an ultraviolet ray absorbing group represented by the general formula (III) wherein $R_{11}$, $R_{12}$, $R_{14}$ and $R_{15}$ each represents a hydrogen atom, $R_{13}$ represents a hydrogen atom or an alkyl group having 1 to 5 carbon atoms, $R_{16}$ represents a hydrogen atom, $R_{17}$ represents a cyano group, and $R_{18}$ represents —$COOR_{20}$ wherein $R_{20}$ represents an alkylene group having 1 to 20 carbon atoms which is bonded to a vinyl group.

Further, monomers (comonomer) used for copolymerizing with the ultraviolet ray absorbing monomer include acrylic acid, α-chloroacrylic acid, α-alkylacrylic acid (for example, esters, preferably, lower alkyl esters, and amides derived from acrylic acids such as methacrylic acid, etc., for example, acrylamide, methacrylamide, methyl acrylate, methyl methacrylate, ethyl acrylate, ethyl methacrylate, n-propyl acrylate, n-butyl acrylate, n-hexyl acrylate and lauryl methacrylate, etc.), vinyl esters (for example, vinyl acetate, etc.), acrylonitrile, methacrylonitrile, aromatic vinyl compounds (for example, styrene and derivatives thereof such as vinyltoluene or divinylbenzene, etc.), itaconic acid, crotonic acid, vinylidene chloride, vinyl alkyl ethers (for example, vinyl ethyl ether, etc.), maleic acid esters, N-vinyl-2-pyrrolidone, N-vinylpyridine and 2- and 4-vinylpyridines, etc.

Among them, acrylic acid esters, methacrylic acid esters and aromatic vinyl compounds are preferable.

Two or more of the above described comonomers may be used together.

For example, n-butyl acrylate and divinylbenzene, styrene and methyl methacrylate, or methyl acrylate and methacrylic acid, etc. can be used.

The ethylenically unsaturated monomers for copolymerizing with the ultraviolet ray absorbing monomer represented by the above described general formula (I) can be selected such that physical properties and/or chemical properties of the formed copolymer, for example, solubility, compatibility with the binder in the photographic colloid composition, such as gelatine, or other photographic additives such as the known photographic ultraviolet ray absorbing agents, known photographic antioxidants or known color image forming agents, flexibility thereof and thermal stability thereof, etc. are subject to good influence.

For example, when increasing the hardness of the latex itself in order to increase the hardness of the hydrophilic colloid layer to which the latex is added, it is preferred to use comonomers having a high glass transition temperature (Tg) (for example, styrene and methyl methacrylate).

The ultraviolet ray absorbing polymer latex used in the present invention may be produced by an emulsion polymerization process or may be produced by a process which comprises stirring a solution prepared by dissolving an oleophilic polymer obtained by polymerization of an ultraviolet ray absorbing monomer in an organic solvent (for example, ethyl acetate) in an aqueous solution of gelatin together with a surface active agent to disperse in a latex state.

These processes can be applied to both the formation of homopolymers and the formation of copolymers. In the latter case, it is preferred that the comonomers are liquid, because they serve as a solvent for the ultraviolet ray absorbing momoner which is solid in case of emulsion polymerization. Free radical polymerization of the ethylenically unsaturated solid monomers is initiated by addition of free radicals formed by thermal decomposition of a chemical initiator, function of a reducing agent in the oxidation compound (redox initiator) or physical function such as ultraviolet rays and other high energy radiation or high frequency, etc. to monomer molecule.

Examples of main chemical initiators include persulfates (for example, ammonium and potassium persulfates), hydrogen peroxide, peroxides (for example, benzoyl peroxide, chlorobenzoyl peroxide, etc.) and azonitrile compounds, etc. Examples of the conventional redox initiator include hydrogen peroxide-iron (II) salt, potassium persulfate-potassium bisulfate, and cerium salt-alcohol, etc.

Examples of initiators and their function have been described in F. A. Bovey; "Emulsion Polymerization" Interscience Publishers Inc. New York, 1955, pages 59–93.

Emulsifiers used for emulsion polymerization include compounds having surface activity such as sulfonates, sulfates, cation compounds amphoteric compounds and high polymer protective colloids. Examples of them and their function have been described in Belgische Chemische Industrie, vol. 28, pages 16–20 (1963).

On the other hand, the organic solvent used for dissolving the oleophilic polymer ultraviolet ray absorbing agent when dispersing it in an aqueous solution of gelatin as a latex state is removed by evaporation before application of the dispersion or by evaporation during drying of the dispersion applied (though the latter is not so suitable). As the solvent to be removed, there are those which have a certain degree of solubility in water so as to be removed by washing with water the gelatin noodle, and those which are removed by spray drying or by a vacuum or steam purging method.

Further, examples of the organic solvents which can be removed include esters (for example, lower alkyl esters), lower alkyl ethers, ketones, halogenated hydrocarbons (for example, methylene chloride and trichloroethylene, etc.), fluorinated hydrocarbons, alcohols (for example, n-butyl alcohol to octyl alcohol) and combinations of them.

The solvent can be used in an amount of 100 to 1,000% by weight based on the weight of the polymer latex.

The dispersing agent for dispersing the oleophilic polymer ultraviolet ray absorbing agent may be any type of material, but ionic surface active agents and, particularly, anionic surface active agents are preferred.

Further, ampholytic type dispersing agents such as C-cetylbetaine, N-alkylaminopropionic acid salts or N-alkyliminodipropionic acid salts can also be used.

The dispersing agent can be used in an amount of 1 to 100% by weight based on the weight of the polymer latex.

In order to increase the dispersion stability and to improve the flexibility of the emulsion coated, a small amount (not more than 50% by weight of the ultraviolet ray absorbing polymer) of a permanent solvent, namely, a water-immiscible organic solvent having a high boiling point (i.e., above 200° C.) may be added. It is necessary for the concentration of the permanent solvent to be sufficiently low in order to plasticize the polymer while it is kept in a state of a solid particle. Furthermore, when using the permanent solvent, it is preferred that the amount thereof is as small as possible so as to reduce the thickness of the final emulsion layer or the hydrophilic colloid layer in order to maintain good sharpness.

It is preferred that the ratio of the ultraviolet ray absorbing agent moiety (monomer represented by the general formula (I)) in the ultraviolet ray absorbing polymer latex of the present invention is generally 5 to 100% by weight, but a ratio of 50 to 100% by weight is particularly preferred from the viewpoint of stability.

In the following, typical examples of the ultraviolet ray absorbing monomer represented by the above described general formula (I) of the present invention are described, but the compound used in the present invention is not limited to them.

(1)

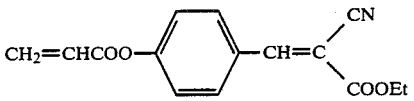

(2)

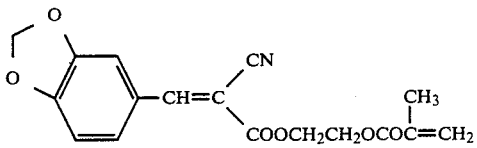

(3)

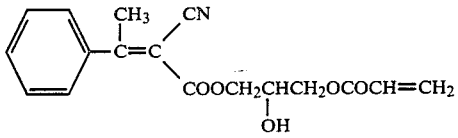

(4)

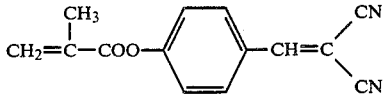

(5)

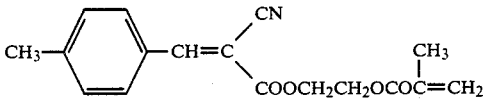

(6)

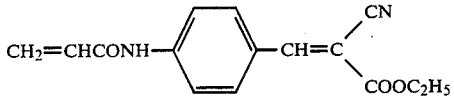

(7)

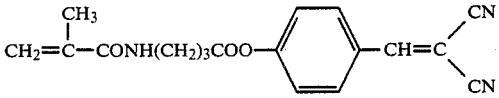

(8)

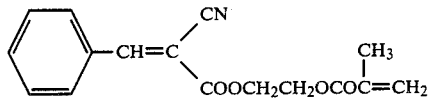

(9)

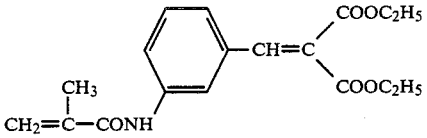

(10)

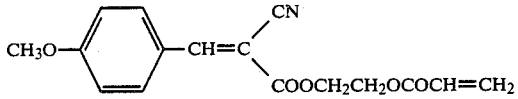

(11)

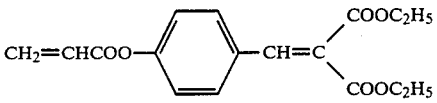

(12)

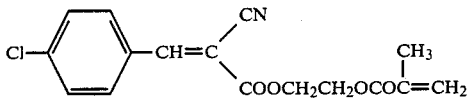

(13)

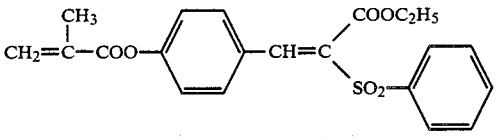

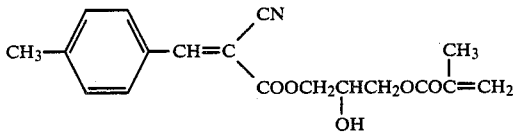

(15)

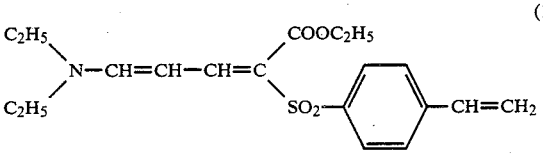

(16)

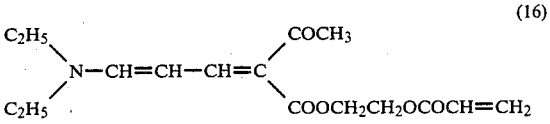

-continued (17)

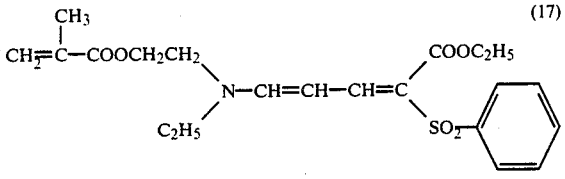

(18)

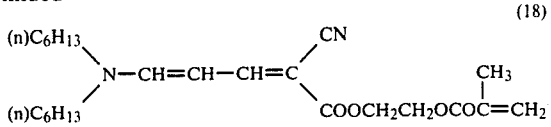

(19)

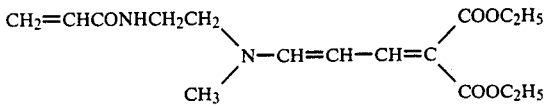

(20)

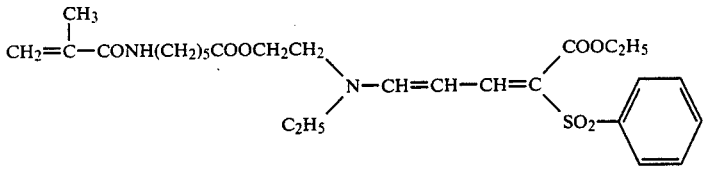

(21)

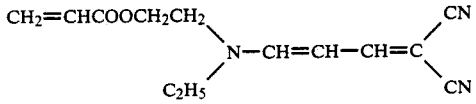

In the following, examples of preferred polymer or copolymer ultraviolet ray absorbing agents used in the present invention are described.

P-1–P-21: Homopolymers of Compounds (1)–(21)

P-22: Copolymer of Compound (5):Methyl methacrylate=7:3

P-23: Copolymer of Compound (5):Methyl methacrylate=5:5

P-24: Copolymer of Compound (5):Methyl acrylate=7:3

P-25: Copolymer of Compound (8):Styrene=5:5

P-26: Copolymer of Compound (8):Butyl acrylate=7.5:2.5

P-27: Copolymer of Compound (1):Methyl methacrylate=7:3

P-28: Copolymer of Compound (1):Methyl methacrylate=5:5

P-29: Copolymer of Compound (8):Methyl acrylate=7:3

P-30: Copolymer of Compound (2):Methyl methacrylate=5:5

P-31: Copolymer of Compound (16):Methyl methacrylate=7:3

P-32: Copolymer of Compound (16):Methyl acrylate=5:5

P-33: Copolymer of Compound (15):Methyl methacrylate=8:2

P-34: Copolymer of Compound (15):Methyl methacrylate=5:5

P-35: Copolymer of Compound (21):n-Butyl acrylate=7:3

(The above ratios are by weight).

The ultraviolet ray absorbing monomers represented by the general formula (I) can be synthesized by the process described in, for example, U.S. Pat. No. 4,200,464 or 4,195,999 (incorporated herein by reference to disclose such methods of synthesizing), Beilsteins Handbuch der Organischen Chemie (the 4th eddition) vol. 10, page 521 (1942), or Japanese Patent Application (OPI) No. 56620/76 with acid halide of acrylic acid or α-substituted acrylic acid such as acryloyl chloride or methacryloyl chloride, and they can be synthesized by reacting 2-cyano-3-phenylacrylic acid with hydroxyethyl acrylate, hydroxyethyl methacrylate or glycidyl acrylate, etc. as described in Japanese Patent Publication 28122/74 or Japanese Patent Application (OPI) 11102/73.

Typical examples of synthesizing the compounds used in the present invention are described in the following.

(A) Monomer Compound

SYNTHESIS EXAMPLE 1 (Compound (5))

Tolualdehyde (400 g), cyanoacetic acid (311 g), acetic acid (60 ml) and ammonium acetate (25.6 g) were refluxed for 4 hours by heating in ethyl alcohol (1.6 l). After the reaction, ethyl alcohol was concentrated to 600 ml under a reduced pressure, and it was poured in 1 liter of iced water to separate crystals. The separated crystals were filtered out by suction to obtain 2-cyano-3-(4-methylphenyl)acrylic acid which melted at 210°–215° C. in a yield of 560 g. This compound (320 g) and thionyl chloride (252 g) were dissolved in acetonitrile (200 ml) by heating for 1 hour. After the reaction, acetonitrile and thionyl chloride were distilled off under a reduced pressure, and the resulting solid was added to a solution composed of hydroxyethyl methacrylate (244.8 g), pyridine (149 g) and acetonitrile (2 liters). The reaction was carried out for 2 hours while keeping the reaction temperature at 40° C. or less. After the reaction, the reaction solution was poured in iced water to separate crystals. The resulting crystals were recrystallized from ethyl alcohol (3 liters) to obtain 360 g of the desired product which melted at 74°–75° C.

The desired product was confirmed by the results of IR, NMR and elemental analysis.

Elemental analysis ($C_{17}H_{17}NO_4$): Calculated: H: 5.72%, C: 68.22%, N: 4.68%, Found: H: 5.75%, C: 68.16%, N: 4.76%.

$\lambda_{max}^{CH_3OH}=311$ nm.

SYNTHESIS EXAMPLE 2 (Compound (8))

Benzaldehyde (200 g), cyanoacetic acid (176 g), acetic acid (30 ml) and ammonium acetate (14.5 g) were refluxed for 4 hours by heating in ethyl alcohol (800 ml). After the reaction, ethyl alcohol was concentrated to 400 ml under a reduced pressure, and it was poured in 1 liter of iced water to separate crystals. The resulting crystals were recrystallized from 250 ml of acetonitrile to obtain 2-cyano-3-phenylacrylic acid which melted at 184°-188° C. in a yield of 265 g. This compound (150 g) and thionyl chloride (176 g) were dissolved in acetonitrile (100 ml) by heating for 1 hour. After the reaction, acetonitrile and thionyl chloride were distilled off under a reduced pressure, and the resulting solid was added to a solution composed of hydroxyethyl methacrylate (124 g), pyridine (75 g) and acetonitrile (1 liter). The reaction was carried out for 2 hours while keeping the reaction temperature at 40° C. or less. After the reaction, the reaction solution was poured in ice water to separate crystals. The resulting crystals were recrystallized from ethyl alcohol (1 l) to obtain 205 g of the desired product which melted at 68°-70° C.

The desired product was confirmed by the results of IR, NMR and elemental analysis.

Elemental analysis ($C_{16}H_{14}NO_4$): Calculated: H: 4.96%, C: 67.60%, N: 4.93%, Found: H: 4.87%, C: 67.65%, N: 4.99%.

$\lambda_{max}^{CH3OH}=298$ nm.

(B) Polymer Compound

SYNTHESIS EXAMPLE 3 Homopolymer latex of Compound (5)

600 ml of an aqueous solution containing 10 g of sodium salt of oleyl methyltauride was heated to 90° C. while slowly passing a nitrogen stream under stirring. To the mixture, 20 ml of an aqueous solution containing 350 mg of potassium persulfate was added. A solution prepared by dissolving 50 g of the ultraviolet ray absorbing monomer (5) in 200 ml of ethanol was then added thereto. After addition, the mixture was heated to 85°-90° C. for 1 hour with stirring. Thereafter, 10 ml of an aqueous solution containing 150 mg of potassium persulfate was added. After reaction for 1 hour, ethanol was removed as an azeotropic mixture together with water. The resulting latex was cooled and it was filtered after the pH was adjusted to 6.0 with 1N-sodium hydroxide. The polymer concentration in the latex was 7.81%. Further, the latex had an absorption maximum of 330 nm in the aqueous solvent system.

SYNTHESIS EXAMPLE 4

Copolymer latex of Compound (5) and methyl methacrylate.

4 liters of an aqueous solution containing 75 g of sodium salt of oleyl methyltauride was heated to 90° C. with slowly passing a nitrogen stream under stirring. To the mixture, 50 ml of an aqueous solution containing 2.6 g of potassium persulfate was added.

A solution prepared by dissolving 300 g of the ultraviolet ray absorbing monomer (5) and 60 g of methyl methacrylate in 1 liter of ethanol was then added thereto. After addition, the mixture was heated to 85°-90° C. for 1 hour with stirring. Thereafter, 20 ml of an aqueous solution containing 1.1 g of potassium persulfate was added. After reacting for another 1 hour, ethanol was removed as an azeotropic mixture together with water. The resulted latex was cooled and it was filtered after the pH was adjusted to 6.0 with 1N-sodium hydroxide. The polymer concentration in the latex was 9.42%. The value of nitrogen analysis showed that the formed copolymer contained 78.9% of the ultraviolet ray absorbing monomer unit. Further, the latex had an absorption maximum of 327 nm in the aqueous solvent system.

SYNTHESIS EXAMPLE 5

Example 1 of synthesizing an oleophilic polymer ultraviolet ray absorbing agent.

21 g of the ultraviolet ray absorbing monomer (8) and 9 g of methyl acrylate were dissolved in 150 ml of dioxane. After 270 mg of 2,2'-azobis-(2,4-dimethylvaleronitrile) which was dissolved in 5 ml of dioxane was added to the resulting solution with stirring at 70° C. under a nitrogen stream, the reaction was carried out for 5 hours. The product was then poured into 2 liters of ice water, and separated solid was filtered out and sufficiently washed with water. The resulting product was dried to obtain 25.3 g of an oleophilic polymer ultraviolet ray absorbing agent. As a result of nitrogen analysis of this oleophilic polymer ultraviolet ray absorbing agent, the formed copolymer contained 64.5% of the ultraviolet ray absorbing monomer unit.

$\lambda_{max}^{CH2COOC2H5}=300$ nm.

Process for producing ultraviolet ray absorbing polymer latex (A):

Firstly, two kinds of solution (a) and (b) were prepared as follows.

(a) 70 g of a 10 wt% aqueous solution of bone gelatin (pH 5.6 at 35° C.) was heated to dissolve at 32° C.

(b) 5 g of the above described oleophilic polymer was dissolved in 20 g of ethyl acetate at 38° C., and a 70 wt% solution of sodium dodecylbenzenesulfonate in methanol was added thereto. Then, the solutions (a) and (b) were put in an explosion-proof mixer. After being stirred at a high rate for 1 minute, operation of the mixer was stopped and ethyl acetate was distilled off under a reduced pressure. Thus, a latex in which the oleophilic polymer ultraviolet ray absorbing agent was dispersed in a diluted aqueous solution of gelatine was produced.

SYNTHESIS EXAMPLE 6

Example 2 of synthesizing an oleophilic polymer ultraviolet ray absorbing agent:

63 g of the ultraviolet ray absorbing monomer (5) and 27 g of methyl methacrylate were dissolved in 450 ml of dioxane. After 810 mg of 2,2'-azobis-(2,4-dimethylvaleronitrile) which was dissolved in 15 ml of dioxane was added to the resulted solution with stirring at 70° C. under a nitrogen stream, the reaction was carried out for 5 hours. The product was then poured into 5 liters of ice water, and separated solid was filtered out and sufficiently washed with water and methanol. The resulting product was dried to obtain 78 g of the oleophilic polymer ultraviolet ray absorbing agent. As a result of nitrogen analysis of this oleophilic polymer ultraviolet ray absorbing agent, the formed copolymer contained 66.3% of the ultraviolet ray absorging monomer unit.

$\lambda_{max}^{CH3COOC2H5}=315$ nm.

Process for producing ultraviolet ray absorbing polymer latex (B):

Polymer latex (B) was produced by the same procedure as that in the process for producing the above described polymer latex (A).

The amount of the ultraviolet ray absorbing polymer latex used in the present invention is not particularly restricted, but it is preferably in a range of 10 to 2,000 mg, more preferably 50 to 1,000 mg, per square meter.

The ultraviolet ray absorbing polymer latex in the present invention is added to the layer between the base and a silver halide emulsion layer (for example, antihalation layer) or the gelatin back layer.

Examples of the light-sensitive materials of the present invention include color negative films, color reversal films, color papers and color diffusion transfer sensitive materials, etc.

In the following, other compositions of the silver halide photographic sensitive materials of the present invention are described in brief.

The protective colloid in the hydrophilic colloid layer of the present invention is preferably gelatin, but other hydrophilic colloids can be used.

The silver halide used for the silver halide emulsion layers of the present invention may be any of silver bromide, silver iodobromide, silver iodochlorobromide, silver chlorobromide or silver chloride.

Cadmium salts, zinc salts, lead salts, thallium salts, iridium salts or complex salts thereof, rhodium salts or complex salts thereof, or iron salts or complex salts thereof, etc. may be present in the step of formation of silver halide particles or physical ageing.

The silver halide emulsions of the present invention can be chemically sensitized by conventional methods.

The photographic light-sensitive materials of the present invention may contain color forming couplers, namely, compounds capable of coloring by oxidative coupling with aromatic primary amine developing agents (for example, phenylenediamine derivatives or aminophenyl derivatives, etc.) in the color development processing. For example, useful magenta couplers include 5-pyrazolone couplers, pyrazolobenzimidazole couplers, cyanoacetylcoumarone couplers and ring opened acyl acetonitrile couplers, etc. Examples of the yellow coupler include acylacetamide couplers (for example, benzoylacetanilides and pivaloylacetanilides), etc. Examples of the cyan coupler include naphthol couplers and phenol couplers, etc. These couplers are preferably of the nondiffusible type having a hydrophobic group called a ballast group in the molecule. The couplers may be 4 equivalent type ones or 2-equivalent type ones with respect to silver ions. Further, they may be colored coupler having an effect of color correction or may be couplers which release development restrainer upon development (the so-called DIR coupler).

Furthermore, besides DIR couplers, noncoloring DIR coupling compounds which releases a development restrainer, in which the coupling reaction product is colorless, may be contained.

In carrying out the present invention, the following known antifading agents may be used. Further, the dye image stabilizer used in the present invention may be used alone or as a combination of two or more thereof. Examples of known antifading agents include hydroquinone derivatives, gallic acid derivatives, p-alkoxyphenols, p-oxyphenol derivatives and bisphenols, etc.

Further, in the light-sensitive materials of the present invention, it is possible to use other various materials, for example, surface active agents, gelatin hardeners, lubricants, antifogging agents, stabilizers, antistatic agents, chemical sensitizers, sensitizing coloring matters, dyes, whitening agents, anti-colorfogging agents, matting agents and base supports, etc., which are well known in this field as described in Research Disclosure, 176, 21–28 (December 1978).

Furthermore, with respect to conditions of exposure and development of the light-sensitive materials of the present invention, there is not any special restriction, and the description of the above described Research Disclosure pages 28 to 30 can be referred to.

The present invention is illustrated in greater detail with reference to examples, but the present invention is not limited to them.

EXAMPLE 1

On a cellulose triacetate film base, layers having the following compositions were applied to produce multilayer color light-sensitive materials.

The 1st layer: Antihalation layer (AHL)
- Gelatin layer containing black colloidal silver.

The 2nd layer: Intermediate layer (ML)
- Gelatin layer containing an emulsified dispersion of 2,5-di-t-octylhydroquinone.

The 3rd layer: The 'st red-sensitive emulsion layer ($RL_1$)
- Silver iodobromide emulsion (silver iodide: 5% by mol): Silver coating amount 1.79 g/m$^2$
- Sensitizing dye I: $6\times10^{-5}$ mols per mol of silver
- Sensitizing dye II: $1.5\times10^{-5}$ mols per mol of silver
- Coupler A: 0.04 mols per mol of silver
- Coupler C-1: 0.0015 mols per mol of silver
- Coupler C-2: 0.0015 mols per mol of silver
- Coupler D: 0.0006 mols per mol of silver The 4th layer: The 2nd red-sensitive emulsion layer ($RL_2$)
- Silver iodobromide emulsion (silver iodide: 4% by mol): Silver coating amount 1.4 g/m$^2$
- Sensitizing dye I: $3\times10^{-5}$ mols per mol of silver
- Sensitizing dye II: $1.2\times10^{-5}$ mols per mol of silver
- Coupler A: 0.02 mols per mol of silver
- Coupler C-1: 0.0008 mols per mol of silver
- Coupler C-2: 0.0008 mols per mol of silver The 5th layer: Intermediate layer (ML)
- The same as the 2nd layer.

The 6th layer: The 1st green-sensitive emulsion layer ($GL_1$)
- Silver iodobromide emulsion (silver iodide: 4% by mol): Silver coating amount 1.5 g/m$^2$
- Sensitizing dye III: $3\times10^{-5}$ mols per mol of silver
- Sensitizing dye IV: $1\times10^{-5}$ mols per mol of silver
- Coupler B: 0.05 mols per mol of silver Coupler M-1: 0.008 mols per mol of silver
- Coupler D: 0.0015 mols per mol of silver The 7th layer: The 2nd green-sensitive emulsion layer ($GL_2$)
- Silver iodobromide emulsion layer (silver iodide: 5% by mol): Silver coating amount 1.6 g/m$^2$
- Sensitizing dye III: $2.5\times10^{-5}$ mols per mol of silver
- Sensitizing dye IV: $0.8\times10^{-5}$ mols per mol of silver
- Coupler B: 0.02 mols per mol of silver
- Coupler M-1: 0.003 mols per mol of silver
- Coupler D: 0.0003 mols per mol of silver The 8th layer: Yellow filter layer (YFL)
- Gelatin layer containing yellow colloidal silver and an emulsified dispersion of 2.5-di-t-octylhydroquinone in an aqueous solution of gelatin.

The 9th layer: The 1st blue-sensitive emulsion layer ($BL_1$)
- Silver iodobromide emulsion (silver iodide: 6% by mol): Silver coating amount 1.5 g/m$^2$
- Coupler Y-1: 0.25 mols per mol of silver The above described Compound (8): 0.005 mols per mol of silver The Compound (8) was added as an emulsified dispersion together with Coupler Y-1.

The 10th layer: The 2nd blue-sensitive emulsion layer ($BL_2$)

Silver iodobromide (silver iodide: 6% by mol): Silver coating amount 1.1 g/m$^2$ Coupler Y-1: 0.06 mols per mol of silver The 11th layer: Protective layer (PL)

Application of a gelatin layer containing polymethyl methacrylate particles (diameter: about 1.5)

To each layer, a gelatin hardener and a surface active agent were added in addition to the above described composition.

Compounds used for producing samples:

Sensitizing dye I: Anhydro-5,5'-dichloro-3,3'-di-(γ-sulfopropyl)-9-ethyl-thiacarbocyanine hydroxide.-pyridinium salt.

Sensitizing dye II: Anhydro-9-ethyl-3,3'-di-(γ-sulfopropyl)-4,5,4',5'-dibenzothiacarbocyanine hydroxide.triethylamine salt.

Sensitizing dye III: Anhydro-9-ethyl-5,5'-dichloro-3,3'-di-(γ-sulfopropyl)oxacarbocyanine sodium salt.

Sensitizing dye IV: Anhydro-5,6,5',6'-tetrachloro-1,1'-diethyl-3,3'-di-(β-(β-(γ-sulfopropoxy)ethoxy)ethyl-)imidazolocarbocyanine hydroxide sodium salt.

Coupler A

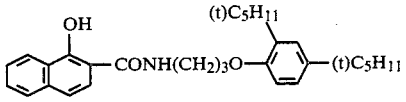

Coupler B

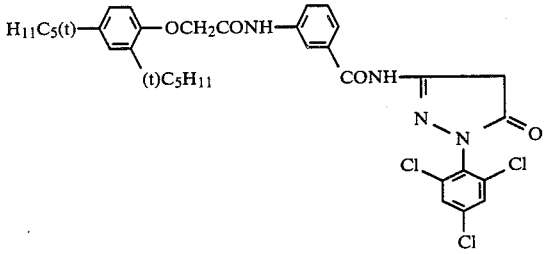

Coupler C-1

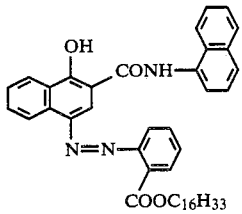

Coupler C-2

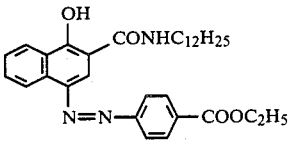

-continued

Coupler D

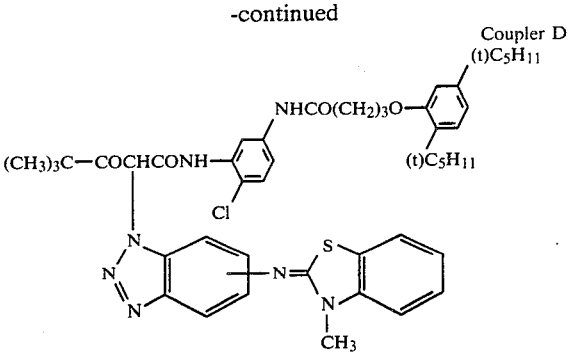

Coupler M-1

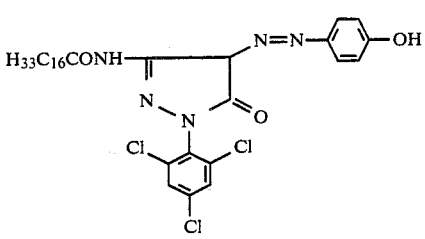

Coupler Y-1

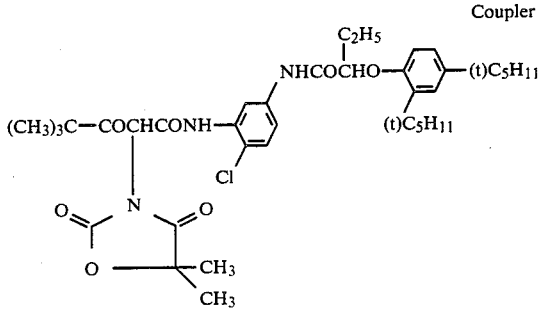

The above described sample was named Sample I.

In order to compare the polymer latexes (A) and (B) prepared in Synthesis Examples 5 and 6 with monomers (8) and (5) thereof and an ultraviolet ray absorbing monomer having the following structure (27), emulsified dispersions (C), (D) and (E) of these monomers (8), (5) and (27) were prepared as follows, and they were added to the antihalation layer of Sample I so as to result in 4.3 g/m$^2$, respectively.

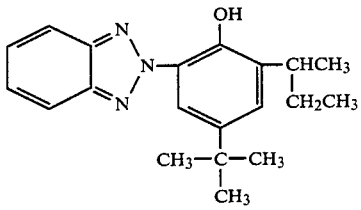

(27)

The coating samples were named Sample II, III, IV, V and VI, in order. The coating property and the antistatic property of these samples were measured by methods described in the following, and results shown in Table 1 were obtained.

(Coating aptitude) Firstly, when the AHL and ML were applied at the same time, the number of oil drops having a size of 30 μm or more based on 100 cm$^2$ was counted. It is desirable that oil drops be not present at all. When 50 or more drops are present, it is unsuitable for use as a light-sensitive material.

(Antistatic property) After the unexposed sample was conditioned at 25° C. and 10% RH for 2 hours, the back face of the sample was rubbed by means of a rubber roll and a nylon bar in a dark room under the same condition as described above. Thereafter, it was subjected to the following development processing, and the degree of generation of static marks was examined.

Development was carried out as follows.

1. Color development: 3 minutes and 15 seconds
2. Bleaching: 6 minutes and 30 seconds
3. Water wash: 3 minutes and 15 seconds
4. Fixation: 6 minutes and 30 seconds
5. Water wash: 3 minutes and 15 seconds
6. Stabilization: 3 minutes and 15 seconds Compositions of the processing solutions used in each step were as follows.

Color developing solution:
- Sodium nitrilotriacetate: 1.0 g
- Sodium sulfite: 4.0 g
- Sodium carbonate: 30.0 g
- Potassium bromide: 1.4 g
- Hydroxylamine sulfate: 2.4 g
- 4-(N-Ethyl-N-β-hydroxyethylamino)-2-methylaniline sulfate: 4.5 g
- Water: to make 1 liter Bleaching solution:
- Ammonium bromide: 160.0 g
- Aqueous ammonia (28%): 25.0 ml
- Ethylenediaminetetraacetic acid sodium iron salt: 130 g
- Glacial acetic acid: 14 ml
- Water: to make 1 liter Fixing solution:
- Sodium tetrapolyphosphate: 2.0 g
- Sodium sulfite: 4.0 g
- Ammonium thiosulfate (70%): 175.0 ml
- Sodium bisulfite: 4.6 g
- Water: to make 1 liter Stabilizing solution:
- Formaldehyde: 8.0 ml
- Water: to make 1 liter Results obtained are shown in Table 1.

TABLE 1

| Testing item | Sample I (Control) | Sample II (This invention) | Sample III (This invention) | Sample IV (Comparison) | Sample V (Comparison) | Sample VI (Comparison) |
|---|---|---|---|---|---|---|
| Number of oil drops (based on 100 $cm^2$) | 0 | 0 | 0 | 72 | 65 | 120 |
| Degree of generation of static mark | | | | | | |
| Rubber | D | A | A | B | B | B |
| Nylon | D | A | A | B | B | C |

In the above Table, evaluation of the degree of generation of static mark was carried out on the basis of the following four grade ranking:

A: Generation of static mark is not observed at all.
B: Generation of static mark is slightly observed.
C: Generation of static mark is considerably observed.
D: Generation of static mark is observed on nearly the whole face.

Table 1 clearly shows that the samples in which the ultraviolet ray absorbing polymer latex of the present invention is used for preventing generation of static charges not only have an excellent antistatic effect in that the generation of static mark is hardly observed, but also a good coating property.

EXAMPLE 2

Compounds in Synthesis Examples 3 and 4 were used in amounts of 1.4 cc and 1.6 cc/$m^2$, respectively. A 3/1 copolymer of the following compound (28) and butyl acrylate (solid content: 7.32%) was synthesized by the same manner as in Synthesis Example 4 and it was used in an amount of 2.1 cc/$m^2$:

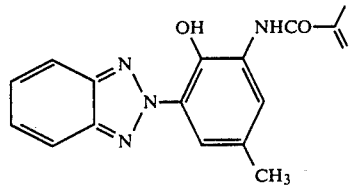

(28)

Compound (28) was added instead of the above described ultraviolet ray absorbing monomer in an amount of 29.7 g to a 10 wt% aqueous solution of gelatin. The prepared emulsions were added to the antihalation layer so as to result in an amount of 4.3 g/$m^2$, respectively, to prepare samples by the same manner as in Example 1. The samples were named Sample VII, VIII, IX and X, in order. The coating aptitude and the antistatic property of them were examined by the same manner as in Example 1. Results are shown in Table 2.

TABLE 2

| Testing item | Sample I | VII | VIII | IX | X |
|---|---|---|---|---|---|
| Number of oil drops (based on 100 $cm^2$) | 0 | 0 | 0 | 83 | 135 |
| Degree of generation of static mark | | | | | |
| Rubber | D | A | A | B | B |
| Nylon | D | A | A | B | C |

Table 2 clearly shows that the samples which satisfy the antistatic property and the coating aptitude contain the ultraviolet ray absorbing polymer latex in accordance with the present invention.

While the invention has been described in detail and with reference to specific embodiment thereof, it will be apparent to one skilled in the art that various changes and modifications can be made therein without departing from the spirit and scope thereof.

What is claimed is:

1. A silver halide photographic light-sensitive material, comprising:
- a support base having provided thereon;
- a light-sensitive silver halide emulsion layer;
- a light-insensitive hydrophilic colloid layer; and
- a layer comprising an ultraviolet ray absorbing latex of an ultraviolet ray absorbing polymer or copolymer having a repeating unit derived from a monomer represented by the following general formula (I) and a hydrophilic colloid, wherein said layer is positioned between the support base and the light-sensitive silver halide emulsion layer or is a back layer positioned on the support base on the side opposite the side having the light-sensitive silver halide emulsion layer, the ultraviolet ray absorbing polymer latex being present in an amount in the range of 10 to 2,000 mg/m$^2$:

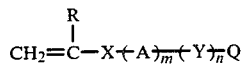

(I)

wherein R represents a hydrogen atom, a lower alkyl group having 1 to 4 carbon atoms or a chlorine atoms, X represents —CONH—, —COO— or a phenylene group, A represents a bonding group selected from an alkylene group having 1 to 20 carbon atoms and an arylene group having 6 to 20 carbon atoms, Y represents —COO—, —OCO—, —CONH—, —NHCO—, —$SO_2$NH—, —NH$SO_2$—, —$SO_2$— or —O—, m and n each represents 0 or 1, and Q represents an ultraviolet ray absorbing group represented by the following general formula (II) or (III):

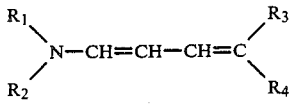

General formula (II)

wherein $R_1$ and $R_2$ each represents a hydrogen atom, an alkyl group having 1 to 20 carbon atoms or an aryl group having 6 to 20 carbon atoms, and $R_1$ and $R^2$ may be identical or different each other, but they do not represent hydrogen atoms at the same time, and $R_1$ and $R_2$ may be united by bonding wherein they represent an atomic group necessary to form a cyclic amino group, $R_3$ represents a cyano group, —$COOR_5$, —$CONHR_5$, —$COR_5$ or —$SO_2R_5$, and $R_4$ represents a cyano group, —$COOR_6$, —$CONHR_6$, —$COR_6$ or —$SO_2R_6$, wherein $R_5$ and $R_6$ each represents an alkyl group having 1 to 20 carbon atoms or an aryl group having 6 to 20 carbon atoms or $R_5$ and $R_6$ may be united by bonding, wherein they represent an atomic group necessary to form a 1,3-dioxocyclohexane ring, a barbituric ring, a 1,2-diaza-3,5-dioxocyclopentane ring or a 2,4-diaza-1-alkoxy-3,5-dioxocyclohexene ring, but at least one of $R_1$, $R_2$, $R_3$ and $R_4$ is necessary to bond to the vinyl group through the bonding group;

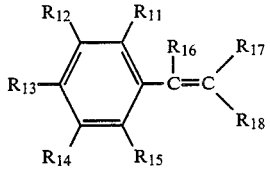

General formula (III)

wherein $R_{11}$, $R_{12}$, $R_{13}$, $R_{14}$ and $R_{15}$ each represents a hydrogen atom, a halogen atom, an alkyl group having 1 to 20 carbon atoms, an aryl group having 1 to 20 carbon atoms, an alkoxy group having 1 to 20 carbon atoms, an aryloxy group having 6 to 20 carbon atoms, an alkylthio group having 1 to 20 carbon atoms, an arylthio group having 6 to 20 carbon atoms, an amino group, an alkylamino group having 1 to 20 carbon atoms, an arylamino group having 6 to 20 carbon atoms, a hydroxyl group, a cyano group, a nitro group, an acylamino group, a carbamoyl group, a sulfonyl group, a sulfamoyl group, a sulfonamide group, an acyloxy group or an oxycarbonyl group, and $R_{11}$ and $R_{12}$, $R_{12}$ and $R_{13}$, $R_{13}$ and $R_{14}$ or $R_{14}$ and $R_{15}$ may form a 5-member or 6-member ring by ring closure, $R_{16}$ represents a hydrogen atom or an alkyl group having 1 to 20 carbon atoms, $R_{17}$ represents a cyano group, —$COOR_{19}$, —$CONHR_{19}$, —$COR_{19}$ or —$SO_2R_{19}$, and $R_{18}$ represents a cyano group, —$COOR_{20}$, —$CONHR_{20}$, —$COR_{20}$ or —$SO_2R_{20}$, wherein $R_{19}$ and $R_{20}$ each represents an alkyl group having 1 to 20 carbon atoms or an aryl group having 6 to 20 carbon atoms, but at least one of $R_{11}$, $R_{12}$, $R_{13}$, $R_{14}$, $R_{15}$, $R_{16}$, $R_{17}$ and $R_{18}$ is necessary to bond to the vinyl group through the bonding group wherein the repeating unit derived from a monomer unit represented by the general formula (I) comprises 50 to 100% by weight of the ultraviolet ray absorbing polymer latex.

2. A silver halide photographic light-sensitive material as claimed in claim 1, wherein the ultraviolet ray absorbing group is represented by the general formula (II) wherein $R_1$ and $R_2$ are an alkyl group having 1 to 20 carbon atoms.

3. A silver halide photographic light-sensitive material as claimed in claim 2, wherein $R^3$ is a cyano group or —$SO_2R_5$.

4. A silver halide photographic light-sensitive material as claimed in claim 3, wherein $R_4$ is a cyano group or —$COOR_6$.

5. A silver halide photographic light-sensitive material as claimed in claim 4, wherein $R_5$ and $R_6$ are an alkyl group containing 1 to 20 carbon atoms or an aryl group containing 6 to 20 carbon atoms.

6. A silver halide photographic light-sensitive material as claimed in claim 1, wherein the ultraviolet ray absorbing group is a compound represented by the general formula (II) and further wherein $R_1$ and $R_2$ are an alkyl group having 1 to 6 carbon atoms.

7. A silver halide photographic light-sensitive material as claimed in claim 6, wherein $R_3$ is —$SO_2R_5$.

8. A silver halide photographic light-sensitive material as claimed in clalm 7, wherein $R_4$ is —$COOR_6$.

9. A silver halide photographic light-sensitive material as claimed in claim 8, wherein $R_5$ is a substituted or an unsubstituted phenyl group.

10. A silver halide photographic light-sensitive material as claimed in claim 9, wherein $R_6$ is an alkyl group containing 1 to 20 carbon atoms.

11. A silver halide photographic light-sensitive material as claimed in claim 1, wherein R is a hydrogen atom or a low alkyl group containing 1 to 4 carbon atoms or a chlorine atom, X represents —COO—, and m and n each represent 0, and further wherein the ultraviolet ray absorbing group is represented by the general formula (III) wherein $R_{11}$, $R_{12}$, $R_{14}$ and $R_{15}$ each represent a hydrogen atom, $R_{13}$ represents a hydrogen atom or an alkyl group containing 1 to 5 carbon atoms, $R_{16}$ represents a hydrogen group, $R_{17}$ represents a cyano group, $R_{18}$ represents —$COR_{20}$ wherein $R_{20}$ represents an alkylene group having 1 to 20 carbon atoms which bonds to a vinyl group.

12. A silver halide photographic light-sensitive material as claimed in claim 1, wherein the polymer includes monomers selected from the group of monomers consisting of acrylic acid esters, methacrylic acid esters and aromatic vinyl compounds.

13. A silver halide photographic light-sensitive material as claimed in claim 1, wherein the ultraviolet ray absorbing polymer latex is present in an amount in the range of 50 to 1,000 mg/m$^2$.

14. A silver halide photographic light-sensitive material as claimed in claim 1, wherein the ultraviolet ray absorbing polymer latex is comprised of a homopolymer.

15. A silver halide photographic light-sensitive material as claimed in claim 1, wherein the ultraviolet ray absorbing polymer latex is comprised of a copolymer.

* * * * *